US007291003B1

(12) United States Patent
Okandan et al.

(10) Patent No.: US 7,291,003 B1
(45) Date of Patent: Nov. 6, 2007

(54) MICROMACHINED SPINNERET

(75) Inventors: Murat Okandan, Albuquerque, NM (US); Paul Galambos, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 323 days.

(21) Appl. No.: 10/947,969

(22) Filed: Sep. 23, 2004

(51) Int. Cl.
*B29C 47/08* (2006.01)

(52) U.S. Cl. ..... 425/463; 425/462; 425/464; 425/378.2; 425/DIG. 217; 425/131.5

(58) Field of Classification Search ..... 425/462, 425/463, 464, 378.2
See application file for complete search history.

(56) References Cited

U.S. PATENT DOCUMENTS

| | | | | |
|---|---|---|---|---|
| 5,064,775 | A * | 11/1991 | Chang | 438/163 |
| 5,344,690 | A * | 9/1994 | White et al. | 428/131 |
| 5,922,477 | A * | 7/1999 | Hoyt et al. | 428/596 |
| 5,932,165 | A | 8/1999 | Corbett | 264/328.2 |
| 5,965,237 | A * | 10/1999 | Bruin et al. | 428/156 |
| 5,989,004 | A * | 11/1999 | Cook | 425/131.5 |
| 6,336,801 | B1 * | 1/2002 | Fish et al. | 425/7 |
| 6,413,071 | B1 * | 7/2002 | Helms et al. | 425/192 S |
| 2002/0134063 | A1 | 9/2002 | Berger | 55/528 |
| 2003/0201560 | A1 | 10/2003 | Vollrath | 264/41 |
| 2004/0086591 | A1 | 5/2004 | Vollrath | 425/143 |
| 2004/0102614 | A1 | 5/2004 | Islam | 530/353 |

OTHER PUBLICATIONS

O. Liivak, A. Blye, N. Shah and L.W. Jelinski, "A Microfabricated Wet-Spinning Apparatus to Spin Fibers of Silk Proteins—Property Correlations," *Macromolecules*, vol. 31, pp. 2947-2951, 1998.
A. Seidel, O. Liivak and L.W. Jelinski, "Artificial Spinning of Spider Silk," *Macromolecules*, vol. 31, pp. 6733-6736, 1998.
S.C. Tseng, C.T. Shi, C.L. Kuo and Y. Cheng, "A New Pattern on Fabrication of Fiber Spinnerets by the LIGA Technology," *Proceedings of the Society of Photooptical Instrumentation Engineers* (SPIE), vol. 3680, pp. 518-525, 1999.
J. Radtke, T. Abeln, M. Weikert and F. Dausinger, "High-Precision Micro Cutting of Ceramics with Short-Pulsed Solid-State Lasers," *Proceedings of the Society of Photooptical Instrumentation Engineers* (SPIE), vol. 4088, pp. 252-255, 2000.
F. Vollrath and D.P. Knight, "Liquid Crystalline Spinning of Spider Silk," *Nature*, vol. 410, pp. 541-548, Mar. 29, 2001.
Y. Cheng, B.-Y. Shew, M.K. Chyu, P.H. Chen, "Ultra-Deep LIGA Process and Its Applications," *Nuclear Instruments and Methods in Physics Research A*, vol. 467-468, pp. 1192-1197, 2001.

(Continued)

*Primary Examiner*—Yogendra N. Gupta
*Assistant Examiner*—Maria Veronica Ewald
(74) *Attorney, Agent, or Firm*—John P. Hohimer

(57) ABSTRACT

A micromachined spinneret is disclosed which has one or more orifices through which a fiber-forming material can be extruded to form a fiber. Each orifice is surrounded by a concentric annular orifice which allows the fiber to be temporarily or permanently coated with a co-extrudable material. The micromachined spinneret can be formed by a combination of surface and bulk micromachining.

28 Claims, 14 Drawing Sheets

OTHER PUBLICATIONS

A. Lazaris, S. Arcidiacono, Y. Huang, J.-F. Zhou, F. Duguay, N. Chretien, E.A. Welsh, J.W. Soares and C.N. Karatzas, "Spider Silk Fibers Spun From Soluble Recombinant Silk Produced in Mammalian Cells," *Science*, vol. 295, pp. 472-476, Jan. 18, 2002.

J. Yao, H. Masuda, C. Zhao and T. Asakura, "Artificial Spinning and Characterization of Silk Fiber from *Bombyx mori* Silk Fibroin in Hexafluoroacetone Hydrate," *Macromolecules*, vol. 35, pp. 6-9, 2002.

L. Herbst, J.P. Quitter, G.M. Ray, T. Kuntze, A.O. Weissner, S.V. Govorkov and M. Heglin, "High Peak Power Solid State Laser for Micromachining of Hard Materials," *Proceedings of the Society of Photooptical Instrumentation Engineers* (SPIE), vol. 4968, pp. 134-142, 2003.

G.H. Altman, F. Diaz, C. Jakuba, T. Calabro, R.L. Horan, J. Chen, H. Lu, J. Richmond and D.L. Kaplan, "Silk-Based Biomaterials," *Biomaterials*, vol. 24, pp. 401-416, 2003.

E.Atkins, "Silk's Secrets," *Nature*, vol. 424, p. 1010, Aug. 28, 2003.

H.-J. Jin and D.L. Kaplan, "Mechanism of Silk Processing in Insects and Spiders," *Nature*, vol. 424, pp. 1057-1061, Aug. 28, 2003.

* cited by examiner

MICROMACHINED SPINNERET

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to spinnerets for forming fibers, and in particular to a micromachined spinneret formed from a plurality of layers of polycrystalline silicon and silicon nitride deposited on a substrate and patterned by micromachining to form one or more pairs of concentric orifices therethrough. Embodiments of the micromachined spinneret can be used to form coated fibers, or a thread consisting of a plurality of fibers.

BACKGROUND OF THE INVENTION

Spinnerets are useful to extrude fibers of different types. Genetically modified proteins are now being developed with the goal of producing artificial silk fibers. The formation of artificial silk fibers on a large scale presents many problems which have not yet been solved.

The present invention provides a micromachined spinneret which has applications for the extrusion of fibers from different types of fiber-forming materials including artificial silk, and which provides a capability for co-extrusion of a coating upon the extruded fiber, with the coating including one or more specialized proteins, antibodies, fluorophores, quantum dots or other materials (e.g. carbon nanotubes). Alternately, the micromachined spinneret of the present invention can be used to extrude a fiber while surrounding the extruded fiber with a dispensed fluid to assist in drying or crystallization of the extruded fiber.

Embodiments of the micromachined spinneret of the present invention can also include a heating element surrounding an orifice therein to heat a fiber-forming material immediately prior to extrusion thereof, or a pair of spaced-apart electrodes surrounding the orifice to provide an electrical field across the fiber during extrusion, or both.

Embodiments of the micromachined spinneret of the present invention are also provided to extrude single fibers, or to extrude a plurality of fibers.

These and other advantages of the present invention will become evident to those skilled in the art.

SUMMARY OF THE INVENTION

The present invention relates to a micromachined spinneret which comprises a substrate having a plurality of fluid feed ports formed therein extending through the substrate. At least one first orifice is formed on a major surface of the substrate, with the first orifice comprising polycrystalline silicon and being connected to a first fluid feed port of the plurality of fluid feed ports; and at least one second orifice is formed on the major surface of the substrate as an annulus about each first orifice, with each second orifice comprising polycrystalline silicon and being connected to a second fluid feed port of the plurality of fluid feed ports. The substrate can comprise any material upon which silicon nitride and polycrystalline silicon (also termed polysilicon) can be deposited and, in particular, monocrystalline silicon. Each second orifice can be connected to the second fluid feed port by a fluid channel formed from a plurality of layers of silicon nitride and polycrystalline silicon.

In certain embodiments of the present invention, a heating element can be formed proximate to each first orifice for heating an extrudable fiber-forming material. The heating element can comprise polycrystalline silicon. A pair of spaced-apart electrodes can also be provided about each first orifice to generate an electric field across the orifice in response to an applied voltage. Each electrode can comprise polycrystalline silicon or metal (e.g. platinum).

The first fluid feed port in the micromachined spinneret of the present invention generally has a width of one millimeter or less. Each first orifice therein also generally has a width of 100 microns or less; and each second orifice can have an annular width of, for example, 2-50 microns. Each first orifice can be circular or polygonal or arbitrary shaped. In some embodiments of the present invention, each first orifice of the micromachined spinneret is cross-shaped.

The present invention also relates to a micromachined spinneret that comprises a substrate (e.g. comprising monocrystalline silicon). A first array of orifices is formed on one side of the substrate and connected to a first fluid feed port extending through the substrate, with the first array of orifices being formed from a plurality of deposited and patterned layers of silicon nitride and polycrystalline silicon. A second array of orifices is formed on the same side of the substrate as the first array of orifices, and is formed from the plurality of deposited and patterned layers of silicon nitride and polycrystalline silicon. Each orifice in the second array of orifices has an annular shape and is concentrically located about one of the orifices of the first array of orifices, with the second array of orifices being connected to a second fluid feed port extending through the substrate. The second array of orifices can be connected to the second fluid feed port through a fluid channel formed from the plurality of deposited and patterned layers of silicon nitride and polycrystalline silicon.

A heating element can be formed proximate to each orifice in the first array of orifices, with the heating element comprising, for example, polycrystalline silicon. Alternately, or in conjunction with the heating element, one or more pairs of spaced-apart electrodes can be formed proximate to each orifice in the first array of orifices. Each electrode can comprise polycrystalline silicon or metal.

Each orifice in the first array of orifices can have a width of 100 microns or less; and each orifice in the second array of orifices can have an annular width of 2-50 microns. Each orifice in the first array of orifices can also be circular, polygonal or arbitrarily shaped. In certain embodiments of the present invention, each orifice in the first array of orifices can be cross-shaped (i.e. shaped like a cross). When each orifice in the first array of orifices is cross-shaped, a portion of the cross-shaped orifices in the first array of orifices can be rotated at an angle relative to the remainder of the cross-shaped orifices in the first array of orifices. This angle can be, for example, 450.

The present invention further relates to a micromachined spinneret that comprises a monocrystalline silicon substrate having a plurality of fluid feed ports formed therein extending through the monocrystalline silicon substrate. A plurality of spaced-apart first orifices are formed from a plurality of deposited and patterned layers of silicon nitride and polycrystalline silicon, with the plurality of spaced-apart first orifices being in fluidic communication with one of the plurality of fluid feed ports. A plurality of second orifices in also formed from the plurality of deposited and patterned layers of silicon nitride and polycrystalline silicon, with the plurality of second orifices being in fluidic communication with another of the plurality of fluid feed ports. Each first orifice can have a circular, polygonal or cross shape; and each second orifice can have an annular shape and be formed concentrically about one of the first orifices. An optional heating element can be located about each first orifice to heat a fiber-forming material during extrusion thereof. An optional pair of electrodes can also be located about each first orifice either in combination with the optional heating element, or without the heating element.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1A:
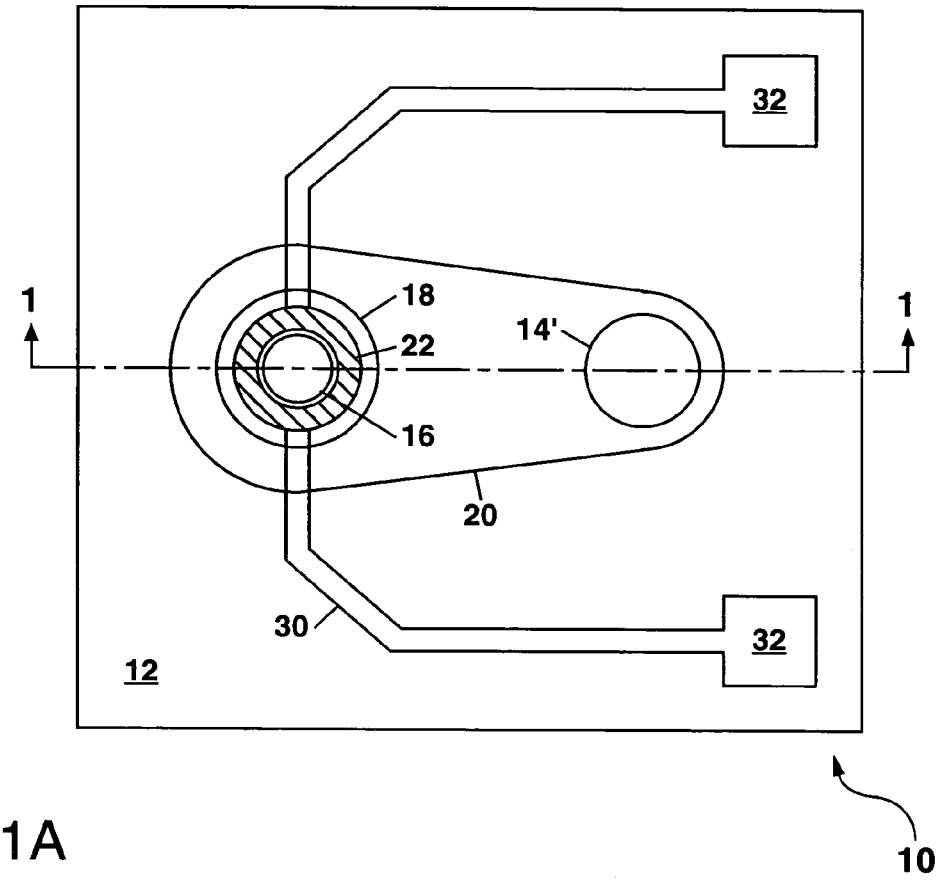
FIGS. 1A and 1B show schematic plan and cross-section views, respectively, of a first example of the micromachined spinneret according to the present invention.

Referring to FIG. 1, there is shown a schematic cross-section view of a first example of a micromachined spinneret 10 according to the present invention. The spinneret 10 comprises a substrate 12 having a pair of fluid feed ports 14 and 14' formed through the substrate 12 from one major surface thereof to the other major surface thereof. The term "fluid" as used herein is intended to include extrudable materials and co-extrudable materials in addition to liquids and gases. A circular orifice 16 is formed on an upper major surface of the substrate 12 from a plurality of layers of deposited and patterned silicon nitride and polycrystalline silicon. The circular orifice 16 (also termed herein a first orifice) is surrounded by an annular orifice 18 (also termed herein a second orifice) which is formed from the same plurality of layers of deposited and patterned silicon nitride and polycrystalline silicon (also termed polysilicon). The annular orifice 18 is connected to fluid feed port 14' through a channel 20 formed from the plurality of layers of deposited and patterned silicon nitride and polysilicon, while the circular orifice 16 is connected directly to fluid feed port 14.

The term "patterned" as used herein refers to a series of process steps which are well-known in the semiconductor device fabrication art including applying a photoresist to the substrate 12, prebaking the photoresist, aligning the substrate 12 with a photomask, exposing the photoresist through the photomask, developing the photoresist, baking the photoresist, etching away surfaces not protected by the photoresist, and stripping the protected areas of the photoresist so that further processing can take place. The term "patterned" can further include the formation of a hard mask (e.g. comprising about 500 nanometers of a silicate glass deposited from the decomposition of tetraethylortho silicate, also termed TEOS, by low-pressure chemical vapor deposition at about 750° C. and densified by a high temperature processing) overlying a polysilicon or sacrificial material layer in preparation for defining features into the layer by anisotropic dry etching (e.g. reactive ion etching).

Figure 1B:
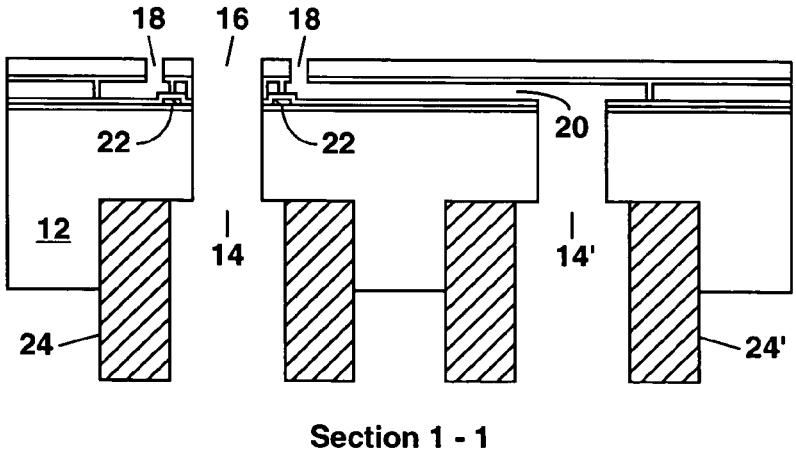
Figure 2:
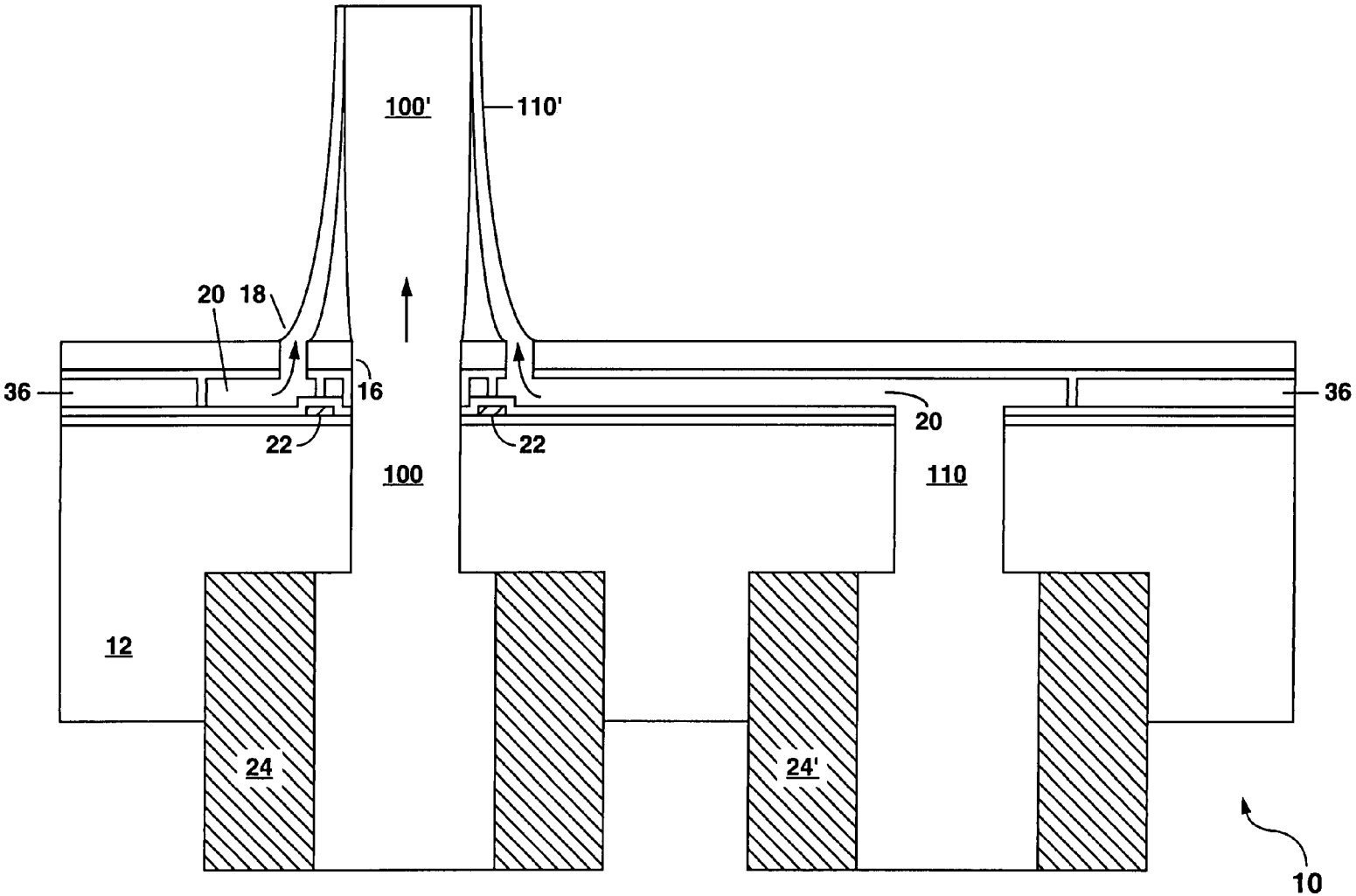
FIG. 2 shows an enlarged cross-section view of the device of FIGS. 1A and 1B along the section line 1-1 in FIG. 1A to illustrate extrusion of a fiber and co-extrusion of a coating material over the fiber.

Returning to FIGS. 1A and 1B, the micromachined spinneret 10 can further include an optional heating element 22 located proximate to the circular orifice 16 to provide resistance heating of a fiber-forming fluid 100 (also termed herein a fiber-forming material) immediately prior to dispensing of the fiber-forming fluid 100 (see FIG. 2). The heating element 22 can also extend into the channel 20 as shown in FIG. 1B to also heat a co-extrudable material 110 immediately prior to dispensing of the material 110. The heating element 22 can be annular in shape to provide an electrical current path around the orifice 16 with electrical connections being made to the heating element 22 through wiring 30 on two opposite sides of the heating element 22. Those skilled in the art will understand that other configurations can be used for the heating element 22.

The circular orifice 16, or alternately a polygonal, cross-shaped or arbitrary-shaped orifice 16, will generally be used to extrude the fiber-forming material 100, which can be provided as a fluid through a supply line 24 (e.g. comprising tubing), and which solidifies or crystallizes after extrusion to form a fiber 100' as shown in FIG. 2. The co-extrudable material 110 is provided as a fluid through another supply line 24', and after co-extrusion forms a coating 110' on the fiber 100'. In some instances, the co-extrudable material 110 will be used to chemically react with or combine with the fiber-forming material 100 (e.g. to form a multi-component fiber). It is also not necessary that the coating 116' be permanently attached to or combined with the extruded fiber 100', although in some instances this will be the case. The coating 110' can be used simply to assist in hardening or crystallization of the fiber 100', or to protect an outer surface of the fiber 100' during such hardening or crystallization (e.g. to prevent adhesion of a plurality of fibers 100' being simultaneously extruded, or to prevent one part of an extruded fiber 100' from adhering to another part of the same fiber 100').

The ability to temporarily or permanently coat an extruded fiber 100' provided by the micromachined spinneret 10 of the present invention allows many different possibilities, and many potential uses for such a coated fiber.

As an example, the co-extruded fiber coating 110' can be used to enhance a chemical resistance of the fiber 100', or to modify its surface properties. Alternately, the fiber 100' and/or the fiber coating 110' can include different types of materials, including antibodies, fluorophores, quantum dots, carbon nanotubes, carbon buckyballs, etc., that can allow the extruded fiber 100' and/or the coating 110' to be used for chemical or biological sensing applications, or for other applications (e.g. hydrogen storage in carbon nanotubes). A temporary coating 110' can be used, for example, to protect the fiber 100' from exposure to the ambient during solidification thereof, to prevent adhesion of the fiber 100' to itself or to another fiber 100' during the extrusion process, or to modify surface properties of the fiber 100'.

The micromachined spinneret 10 of the present invention can also be used to form a hollow fiber. This can be done, for example, by extruding a fiber-forming material from the annular orifice 18 without any fiber-forming fluid 100 being extruded from the circular orifice 16, or alternately with a fluid being dispensed from the circular orifice 16 which does not solidify so that the fluid can be drained from the completed hollow fiber. In some instances, the concentric orifices 16 and 18 can both be annular in shape to form a hollow fiber.

Fabrication of the micromachined spinneret 10 will now be described with reference to FIGS. 3A-3L which show schematic cross-section views of the device 10 during various stages of its fabrication.

Figure 3A:
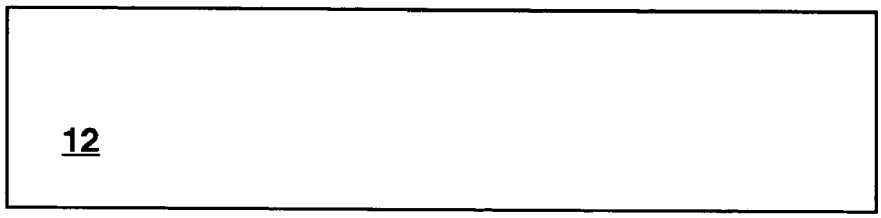
FIGS. 3A-3L show schematic cross-section views along the section line 1-1 in FIG. 1A to illustrate fabrication of the micromachined spinneret of FIGS. 1A and 1B.

In FIG. 3A, a substrate 12 is provided which is generally a monocrystalline silicon substrate 12, or alternately a silicon-on-insulator (SOI) substrate 12. Such monocrystalline silicon and SOI substrates 12 are formed of nonporous silicon. The monocrystalline silicon or SOI substrate 12 can comprise a semiconductor wafer of any standard size (e.g. 6" diameter), or a portion thereof. Those skilled in the art will understand that other types of substrates formed from nonporous materials (e.g. crystalline semiconductors, ceramic, alumina, glass, quartz, or fused silica) are suitable for practice of the present invention.

The substrate 12 can be initially prepared by blanketing the entire substrate 12 with a layer of a thermal oxide (e.g. 630 nanometers thick) formed by a conventional wet oxidation process at an elevated temperature (e.g 1050° C. for about 1.5 hours). The thermal oxide layer is not shown in FIGS. 3B-3L, or in FIGS. 1B and 2.

A layer 26 of low-stress silicon nitride (e.g. 800 nanometers thick) can then be deposited over the thermal oxide layer using low-pressure chemical vapor deposition (LPCVD) at about 850° C. The silicon nitride layer 26 is shown only on the top of the substrate 12 in FIG. 3B for clarity, although those skilled in the art will understand that the silicon nitride layer 26 and other deposited layers described hereinafter can also be deposited on the bottom of the substrate 12 during a blanket deposition process when the bottom of the substrate 12 is exposed during deposition. The silicon nitride layer 26 provides electrical isolation from the substrate 12 for a subsequently-deposited polysilicon layer 28 which will be used to form the heating element 22 and to provide electrical connections thereto.

Figure 3B:
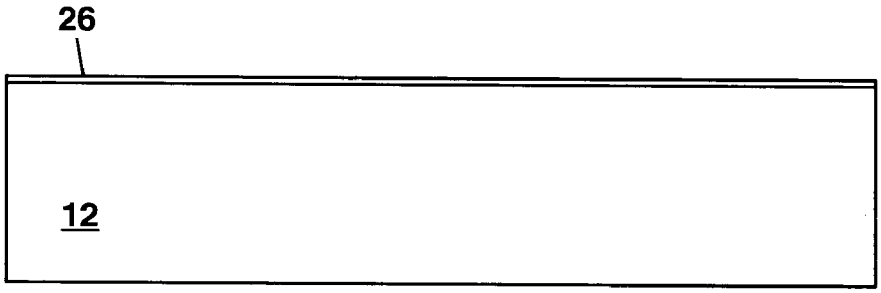
Figure 3C:
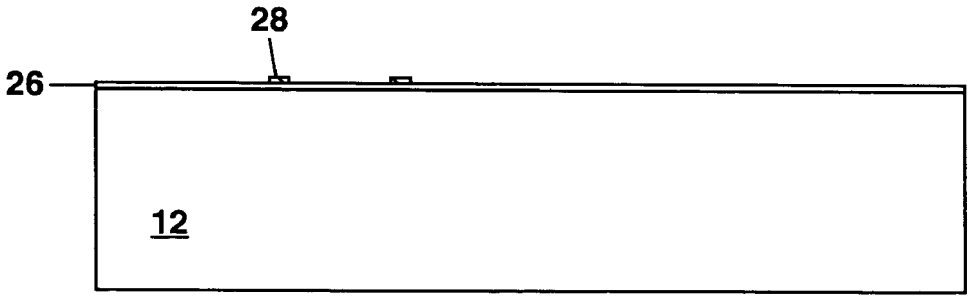

In FIG. 3C, the polysilicon layer 28 is blanket-deposited over the substrate 12 to a layer thickness of, for example, 0.3 μm and patterned using a photolithographically-defined etch mask (not shown) and a reactive ion etch step to form the heating element 22, and also to form electrical wiring 30 and a pair of bond pads 32 (see FIG. 1A). The heating element 22 and wiring 30 can be, for example, up to a few microns wide or more (e.g. ≦50 μm).

The layer 28 (termed herein "Poly-0") and one or more other deposited polysilicon layers can be deposited by LPCVD at a temperature of about 580° C. Phosphorous doping can be used to make the Poly-0 layer 50 electrically conductive as needed to form the heating element 22 and the electrical wiring 30 which connects the heating element 22 to the bond pads 32. The bond pads 32 can be formed from doped polysilicon or from doped polysilicon overcoated with a layer of metal (e.g. aluminum, gold, tungsten or platinum, or an alloy thereof). The phosphorous doping of the Poly-0 layer can be performed using ion implantation or diffusion. The use of ion implantation allows the phosphorous doping to be locally varied, as needed, to control the resistivity of the heating element 22 while providing low-resistance wiring 30.

Figure 3D:
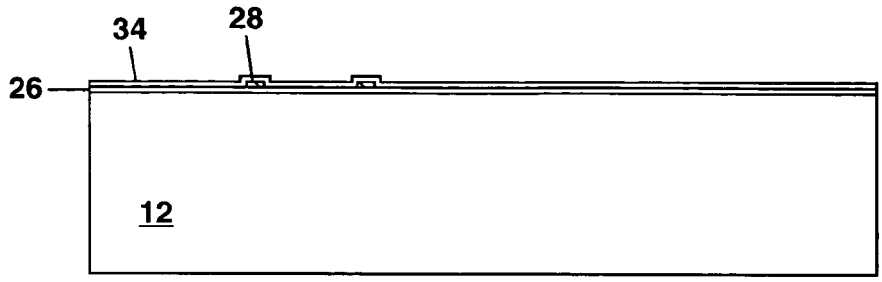

In FIG. 3D, a second layer 34 of silicon nitride, which can be 0.3 μm thick, is blanket deposited over the substrate 12. This silicon nitride layer 34 forms a bottom wall of the channel 20 which is being formed, and also encapsulates the heating element 22.

Figure 3E:
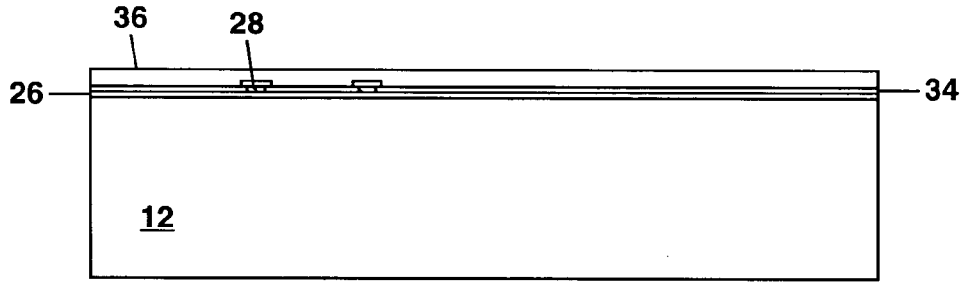

In FIG. 3E, a layer of a sacrificial material 36 is blanket deposited over the substrate 12. The sacrificial material 36 can comprise silicon dioxide or a silicate glass (e.g. TEOS) deposited by LPCVD with a layer thickness of, for example, 2 μm. After deposition, the layer of the sacrificial material 36 can be planarized by a chemical-mechanical polishing step as known to the art.

Figure 3F:
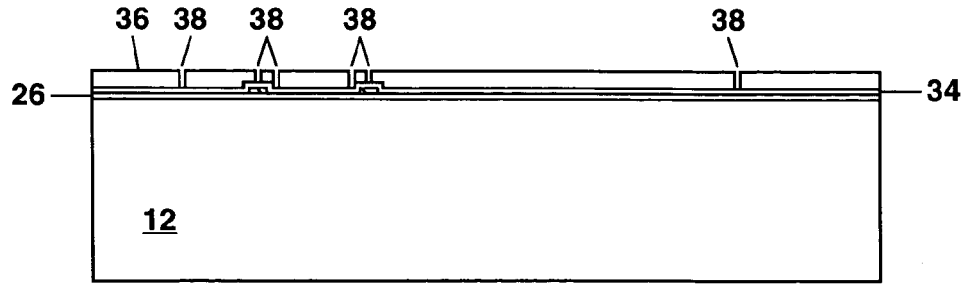
Figure 3G:
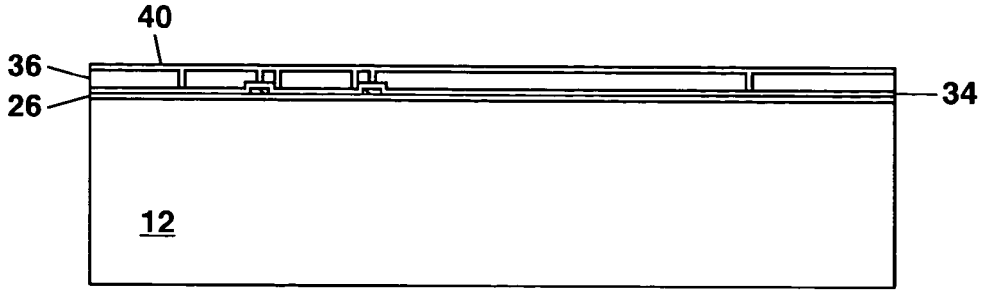

The layer of the sacrificial material 36 can then be patterned to form a plurality of openings 38 as shown in FIG. 3F which define the shapes of the orifices 16 and 18 and the channel 20. In FIG. 3G, another layer 40 of silicon nitride is blanket deposited over the substrate 12 and fills in the openings 38. This layer 40 of silicon nitride can be 0.8 μm thick, for example.

Figure 3H:
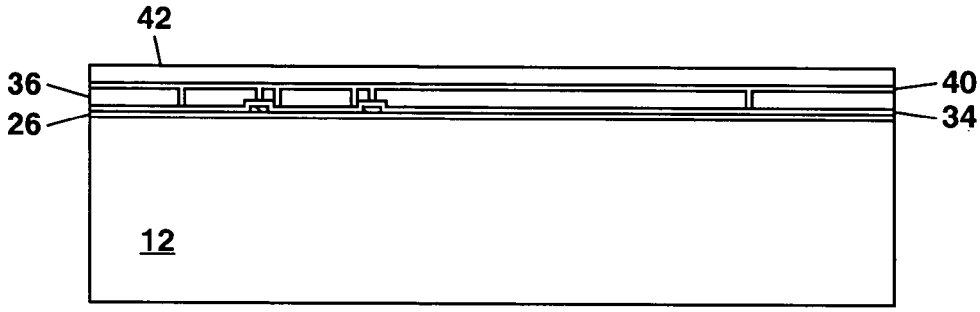
Figure 3I:
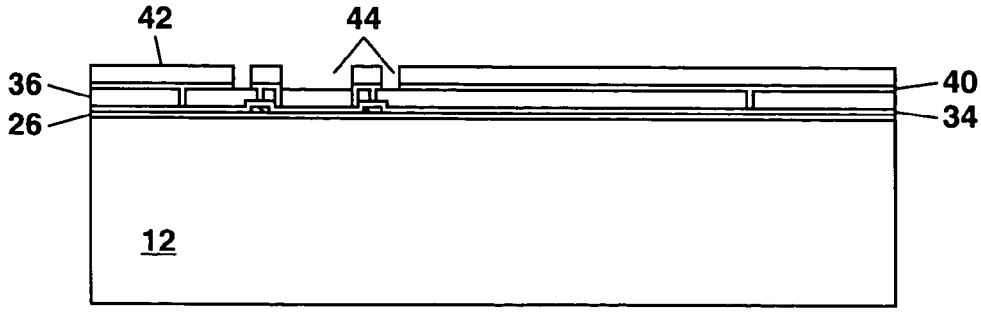

In FIG. 3H, another layer 42 of polysilicon (termed "Poly-3") is blanket deposited over the substrate with a layer thickness of 2.25 μm. The Poly-3 layer 42 can then be patterned to form openings 44 at the locations of the circular orifice 16 and the annular orifice 18. Each circular orifice 16 to be formed from an opening 44 can be 100 μm in diameter or less, and preferably 3-50 μm in diameter. Each annular orifice 18 to be formed from another annular opening 44 can have an annular width in the range of 2-50 μm, and can be spaced from the adjacent circular orifice 16 by a spacing of 2-3 μm. A reactive ion etching step used to form the openings 44 can also be used to etch downward through the underlying silicon nitride layer 40 as shown in FIG. 3I.

Figure 3J:
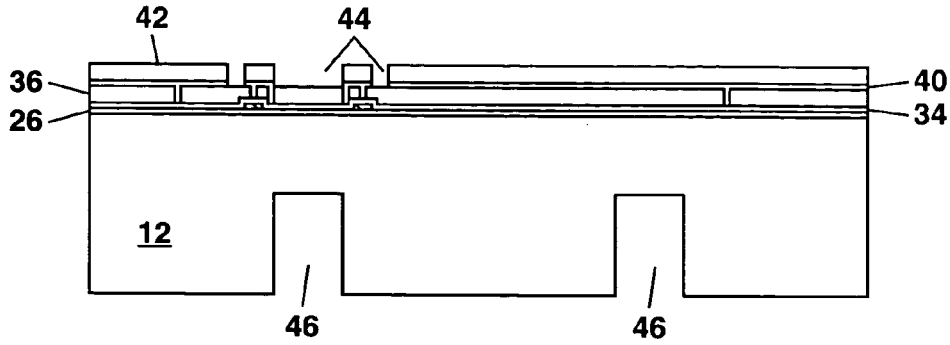

In FIG. 3J, an initial deep reactive ion etching (DRIE) step is performed to etch partially (e.g. about halfway) through the bottom of the substrate 12 using a photolithographically-patterned etch mask (not shown). This forms a shaped opening 46 which is further expanded and deepened in FIG. 3K to extend completely through the substrate 12 after a second DRIE etch step using another photolithographically-patterned etch mask (not shown) to complete the fluid feed ports 14 and 14'. The resulting fluid feed ports 14 and 14' with a stepped profile are useful for attaching the supply lines 24 and 24' to the substrate 12.

The DRIE etch process is disclosed in detail in U.S. Pat. No. 5,501,893 to Laermer, which is incorporated herein by reference. Briefly, the DRIE etch process, which is used to form the shaped openings 46 and the completed fluid feed ports 14 and 14' in FIGS. 3J and 3K, utilizes an iterative Inductively Coupled Plasma (ICP) deposition and etch cycle wherein a polymer etch inhibitor is conformally deposited as a film over the bottom of the substrate 12 and in the openings 46 being etched through the substrate 12 during a deposition cycle, and subsequently preferentially removed during an etching cycle.

Figure 3K:
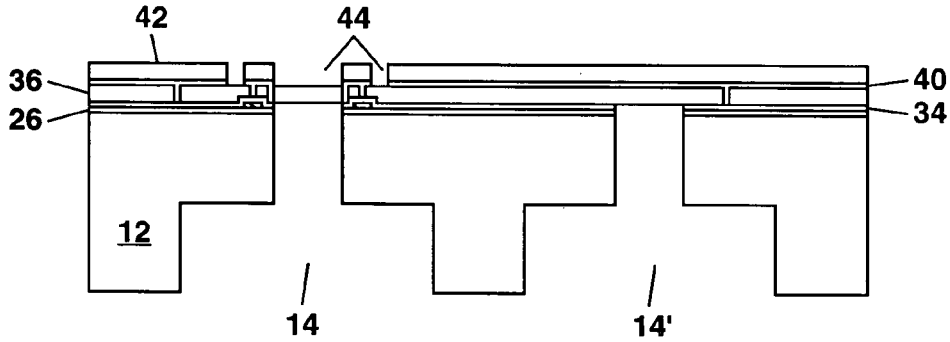

The polymer film, which can be formed in a $C_4F_8$/Ar-based plasma, deposits conformally over a bottom surface and sidewalls of the opening 46 being etched from the bottom of the silicon substrate 12. During a subsequent etch cycle using an $SF_6$/Ar-based plasma, the polymer film is quickly etched away from the bottom surface of the opening 46 so that etching of the underlying silicon substrate 12 can take place, while the polymer film is etched away more slowly from the sidewalls of the shaped opening 46. This exposes the silicon substrate 12 at the bottom surface of the shaped opening 46 to reactive fluorine atoms from the $SF_6$/Ar-based plasma, with the fluorine atoms then being responsible for etching the exposed bottom surface while the sidewalls are protected from being etched by the remaining polymer film. Before the polymer film on the sidewalls of the shaped opening 46 is completely removed by action of the $SF_6$/Ar-based plasma, the polymer deposition step using the $C_4F_8$/Ar-based plasma is repeated. This cycle is repeated many times, with each polymer deposition and etch cycle generally lasting only about 10 seconds or less, until a desired etch depth for the shaped opening 46 is reached in FIG. 3J. With a different etch mask in place for the second DRIE etch step, the above process is repeated to etch completely through the substrate 12 and through the layers 26 and 34 as shown in FIG. 3K to form the fluid feed ports 14 and 14'. The net result is that the fluid feed ports 14 and 14' are formed with a stepped profile and with substantially straight (i.e. vertical) sidewalls.

Figure 3L:
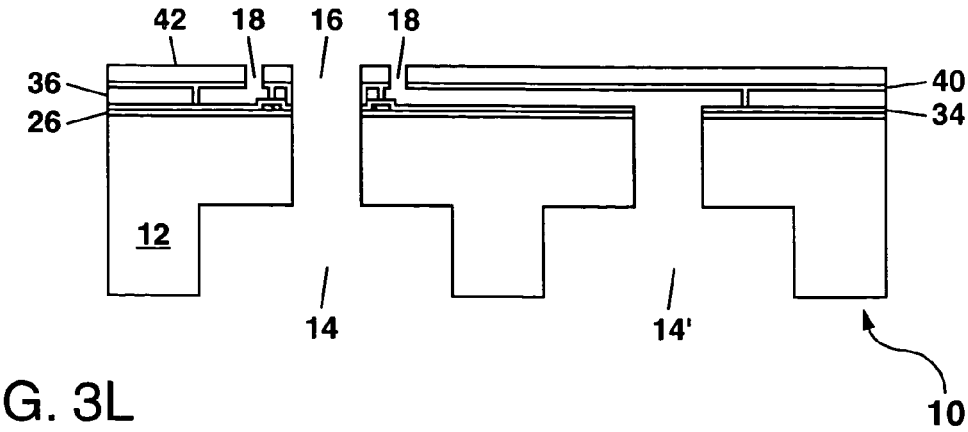

In FIG. 3L, exposed portions of the sacrificial material 36 are removed to open up the channel 20 and the orifices 16 and 18. This can be done by etching the exposed portions of the sacrificial material 36 with a selective wet etchant comprising hydrofluoric acid (HF) which etches away the exposed portions of the sacrificial material 36 while not substantially chemically attacking silicon, polysilicon or silicon nitride. The substrate 12 can be immersed into the selective wet etchant for up to several hours or overnight. Other portions of the sacrificial material 36 are protected from exposure to the selective wet etchant by being encapsulated within the layers 34 and 40 of silicon nitride. These encapsulated portions of the sacrificial material 36 are retained intact to provide structural support for the micromachined spinneret 10.

The supply lines 24 and 24' can be attached to the fluid feed ports 14 and 14' as shown in FIG. 1B to prepare the micromachined spinneret 10 for use. The supply lines 24 and 24' can be attached using an adhesive (e.g. epoxy) or solder. In some instances, the micromachined spinneret 10 can be clamped into a holder having fluid passages therein to provide the fiber-forming material 100 and the co-extrudable material 110 from supply reservoirs to the micromachined spinneret 10.

Electrical contact to the heating element 22 can be made via contact pads 32. An applied voltage to the heating element 22 can then be used to heat the fiber-forming material 100 and the co-extrudable material 110 to a predetermined temperature of up to 100° C., with the exact temperature depending upon a boiling point of the materials 100 and 110 and certain temperature-dependent characteristics of the materials 100 and 110 including viscosity and chemical reactivity.

Figure 4:
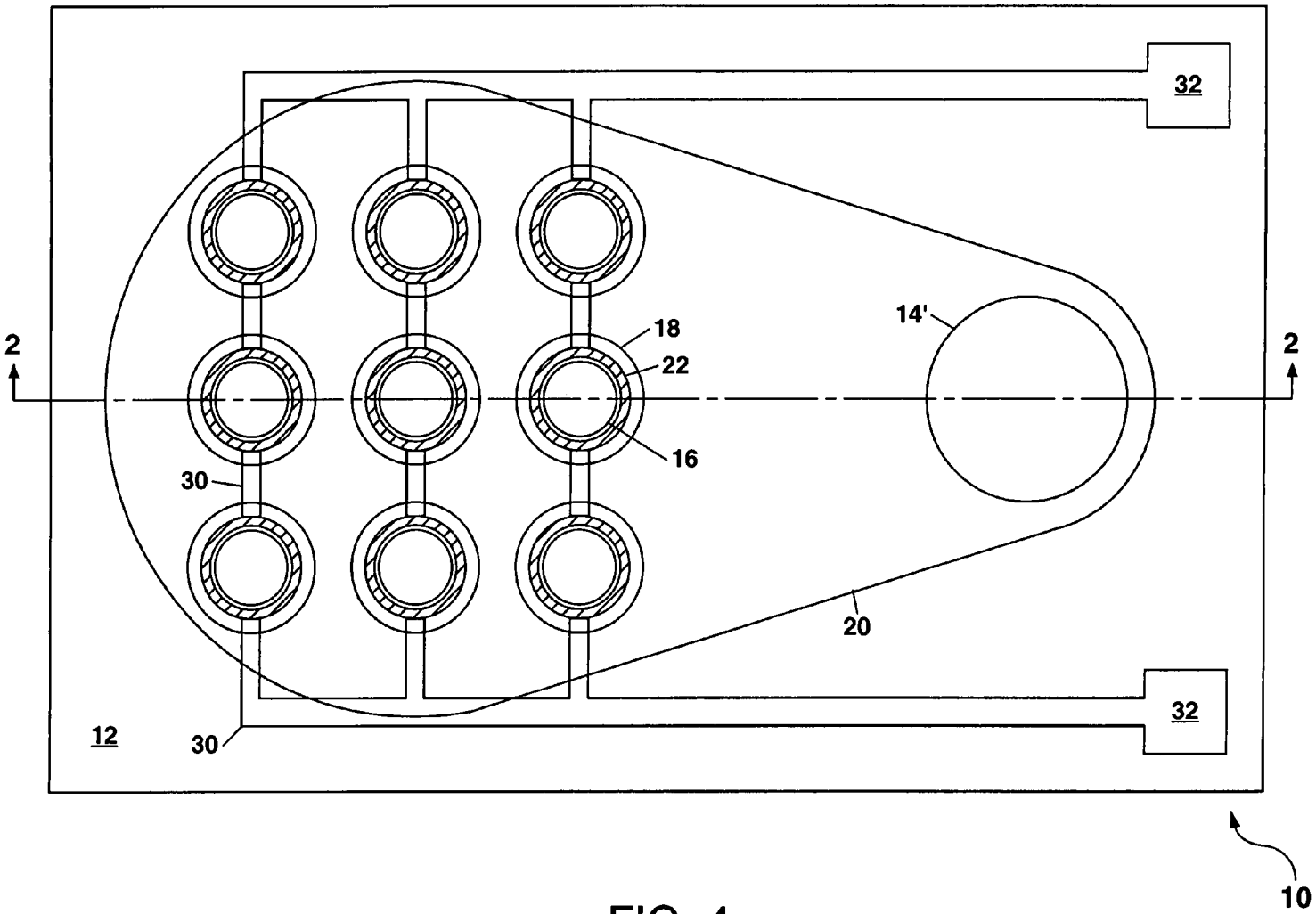
FIG. 4 shows a schematic plan view of a second example of the micromachined spinneret formed according to the present invention.
Figure 5:
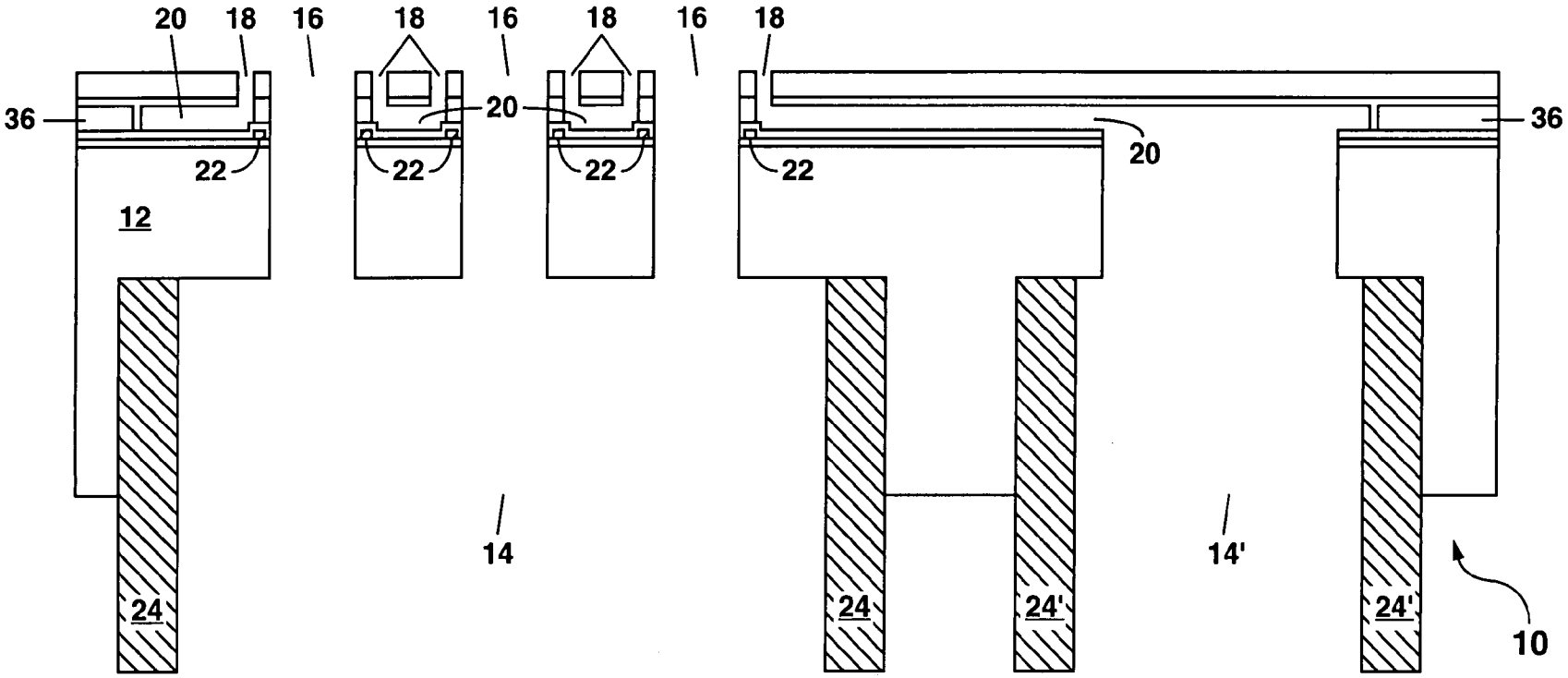
FIG. 5 shows a schematic cross-section view of the device of FIG. 4 along the section line 2-2 in FIG. 4.

FIG. 4 shows a schematic plan view of a second example of the micromachined spinneret 10 of the present invention. In FIG. 4, the micromachined spinneret 10 comprises a first array of orifices 16 and a second array of annular orifices 18 formed concentrically about the first array of orifices 16 (i.e. each orifice 16 has an annular orifice 18 that is formed concentrically about that orifice 16). Although a relatively small number of orifices 16 and 18 are shown in the example of FIGS. 4 and 5, the exact number of orifices 16 or 18 in each array can range up to one hundred or more depending upon a particular application for the micromachined spinneret 10 of the present invention. Each orifice 16 can be spaced apart from an adjacent orifice 16 by a distance which can be, for example, from a few microns up to a few hundred microns.

The micromachined spinneret 10 in this second example of the present invention is useful for extruding a plurality of fibers 110' which can be combined (e.g. by twisting) to form a thread. This example of the present invention can be used, for example, to produce artificial silk fibers using as the fiber-forming material 100 a recombinant silk protein as known to the art, or to produce other types of man-made fibers.

Each orifice 16 can be used to extrude a fiber 100' utilizing a fiber-forming material 100 in the manner previously described with reference to FIG. 2. Each annular orifice 18 can be used to co-extrude a temporary or permanent fiber coating 110' utilizing a co-extrudable material 110. A heating element 22 can be provided in the micromachined spinneret 10 to surround each orifice 16 to heat the fiber-forming material 100 and the co-extrudable material 110 at a point proximate to where these materials are to be extruded from the orifices 16 and 18. The fiber coating 110' can, in some instances, be used to prevent a plurality of extruded fibers 100' from sticking together during extrusion of the fibers 100', or in other instances can be used to attach the fibers 100' together. The fiber coating 110' can also function as previously described with reference to FIG. 2. In some instances, the co-extrudable material 110 can be a gas which is used to surround the extruded fiber 100' at the point where it exits the orifice 16 to aid in solidifying or crystallizing the fiber 100', or to dry or chemically react with an exposed surface of the fiber 100'.

The various heating elements 22, which can be formed from the Poly-0 layer 28, can be connected in a series/parallel arrangement as shown in FIG. 4 so that an external voltage can be applied using a single pair of contact pads 32. Those skilled in the art will understand that other arrangements for supplying electricity to the heating elements 22 are possible. By providing a higher phosphorous dopant concentration in the wiring 30 as compared to the heating elements 22 using ion implantation of the Poly-0 layer 28, the heating in response to an applied voltage can be concentrated in the heating elements 22 with little or no heating being produced in the wiring 30.

The second example of the micromachined spinneret 10 of the present invention can be fabricated by surface and bulk micromachining in a manner similar to that previously described with reference to FIGS. 3A-3L. Two DRIE etch steps as described previously with reference to FIGS. 3J and 3K can be used for bulk micromachining of the substrate 12 to form the fluid feed ports 14 and 14' and to etch completely through the substrate 12 at the locations of each orifice 16. In the steps for patterning the sacrificial material 36 and depositing the second silicon nitride layer 40 as described with reference to FIGS. 3F and 3G, respectively, portions of the sacrificial material 36 can be encapsulated by the silicon nitride layers 34 and 40 to form islands or ribs (not shown) within the channel 20. This can increase the rigidity of the channel 20 to prevent bowing or rupture of the channel 20 due to the co-extrudable material 110 which is generally provided to the fluid feed port 14' under pressure.

Dimensions of each orifice 16 and 18 for the example of FIGS. 4 and 5 can be about the same as for the first example of the present invention. Namely, the orifices 16 can have a diameter of 100 μm or less, and preferably 3-50 μm. The annular orifices 18 can have an annular width of 2-50 μm, with the annular width being separated from the orifice 16 by a spacing of 2-3 μm.

Figure 6:
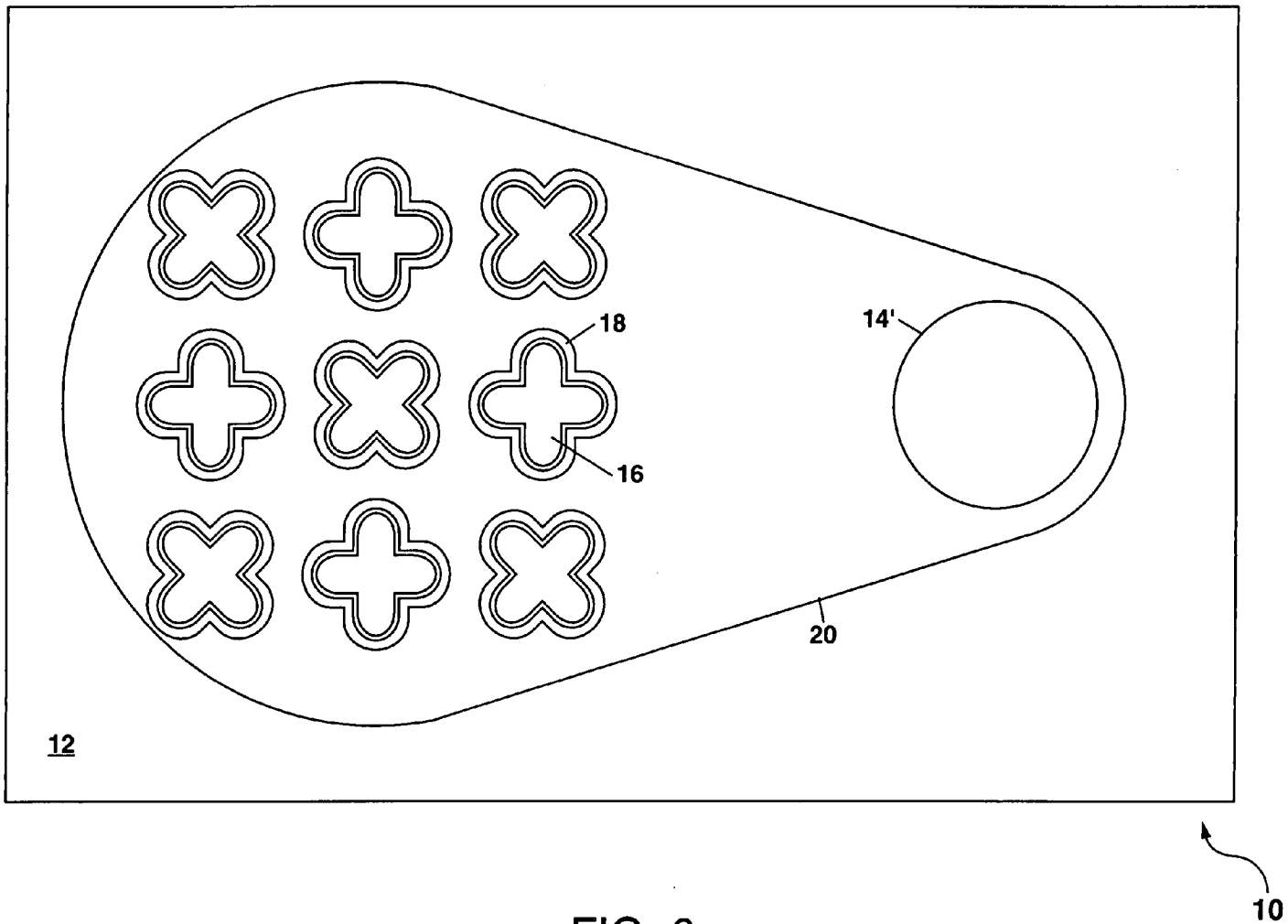
FIG. 6 shows a schematic plan view of a third example of the micromachined spinneret of the present invention.

FIG. 6 shows a schematic plan view of a third example of a micromachined spinneret 10 formed according to the present invention. In the example of FIG. 6, no heating elements 22 are present, although other embodiments of the present invention can include a heating element 22 formed about each orifice 16 as described previously. Those skilled in the art will also understand that, although FIG. 6 shows only a few pairs of concentric orifices 16 and 18, in actuality many more pairs of concentric orifices 16 and 18 may be present, depending upon a particular application of the micromachined spinneret 10 of FIG. 6. The third example of the micromachined spinneret 10 can be formed by surface and bulk micromachining as previously described with reference to FIGS. 3A-3L, with each orifice 16 being directly connected to a fluid feed port 14 for providing the fiber-forming material 100, and with each orifice 18 being connected through a channel 20 to another fluid feed port 14' to provide the co-extrudable material 110.

In FIG. 6, the orifices 16 are cross-shaped, while the orifices 18 are annular with a cross-shape that allows the orifices 18 to be concentrically located about the orifices 16 to form pairs of concentric orifices. The term "cross-shaped" as used herein to refer to the shape of each pair of concentric orifices 16 and 18 is intended to include any shape having four outward-extending protrusions, including an X-shape and a cloverleaf shape. Additionally, the term "cross-shaped" as used herein denotes a shape wherein the four outward-extending protrusions can have square ends, or rounded ends as shown in FIG. 6. Additionally, the pairs of concentric orifices 16 and 18 need not be oriented all in the same direction, and need not all be of the same size. In the example of FIG. 6, orienting certain of the pairs of concentric orifices 16 and 18 at an angle (e.g. 45°) with respect to the remaining pairs of orifices 16 and 18 can be advantageous to aid in forming the extruded fibers 100' into a thread and for interlocking the various fibers 100' in the thread together.

Figure 7A:
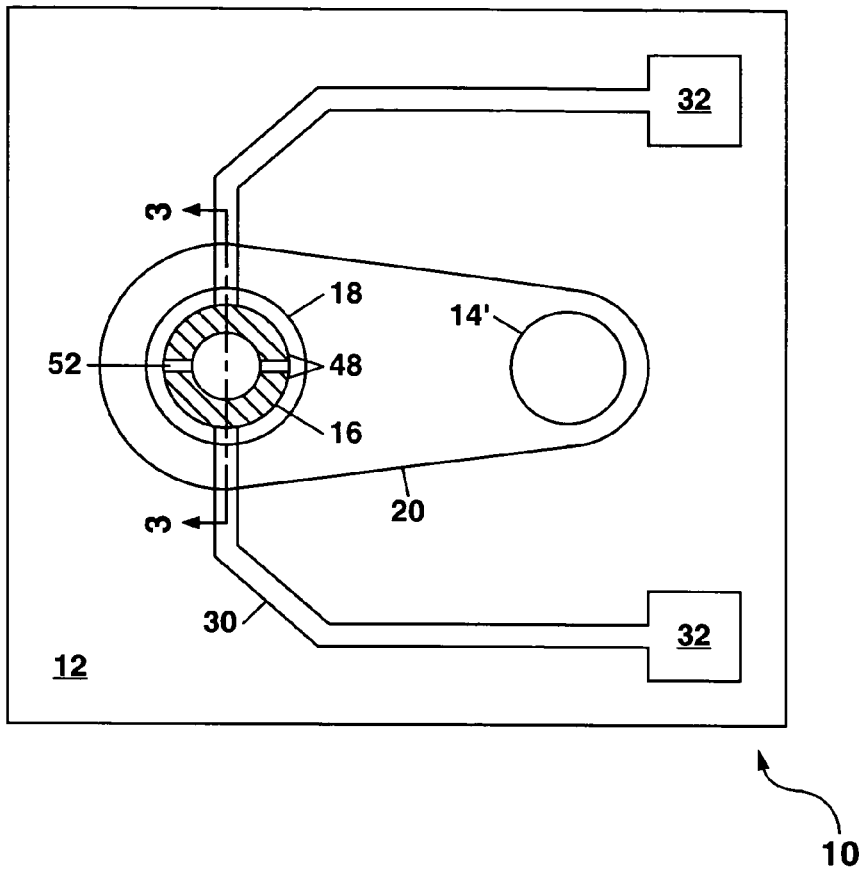
FIGS. 7A and 7B show schematic plan and cross-section views, respectively, of a fourth example of the micromachined spinneret of the present invention.
Figure 7B:
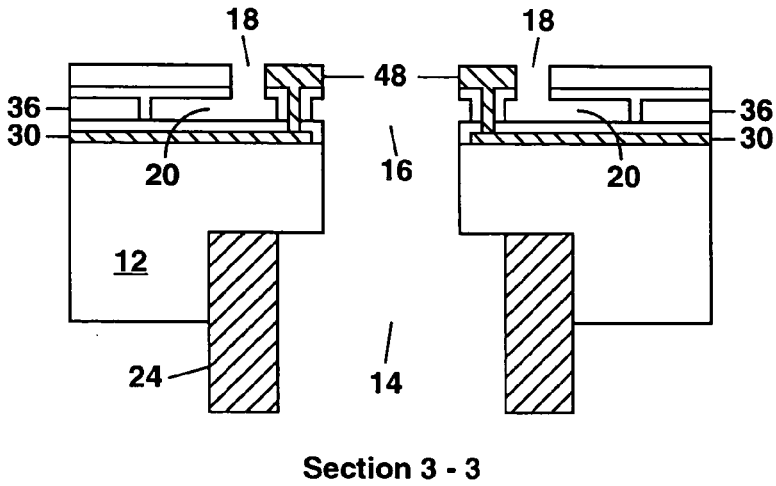

FIG. 7A shows a schematic plan view of a fourth example of the micromachined spinneret 10 of the present invention. FIG. 7B shows a schematic cross-section view of the same device 10 taken along the section line 2-2 in FIG. 7A. The micromachined spinneret 10 in FIGS. 7A and 7B is similar to that of FIGS. 1A and 1B except that a pair of spaced apart arcuate electrodes 48 have been substituted for the heating elements 22 in the example of FIG. 1A.

In the example of FIGS. 7A and 7B, the electrodes 48 can be electrically connected to the wiring 30 and contact pads 32 through the Poly-0 layer 28. With an external voltage applied to the electrodes 48 via contact pads 32 and wiring 30, an electric field can be generated within the orifice 18 between the electrodes 48. This electric field, which can be generated by a series of biphasic voltage pulses, can be used, for example, to orient particular molecules (e.g. polarizable molecules or ions) within a fiber-forming material 100 during extrusion of that material 100, or to produce electrochemical reactions within the fiber-forming material 100. The electrodes 48 can comprise doped polysilicon, or can comprise a metal such as platinum, or both (e.g. polysilicon electrodes 48 overcoated with a layer of metal).

Fabrication of the micromachined spinneret 10 in FIGS. 7A and 7B can proceed in a manner similar to that previously described in FIGS. 3A-3L with modifications to allow the electrodes 48, which are formed from the Poly-3 layer 42, to be electrically connected to the wiring 30, which is formed from the Poly-0 layer 28. A process for fabricating the device 10 of FIGS. 7A and 7B will be described hereinafter with reference to FIGS. 8A-8I which show schematic cross-section views along the section line 3-3 in FIG. 7A during various steps in the manufacture of the micromachined spinneret 10.

Figure 8A:
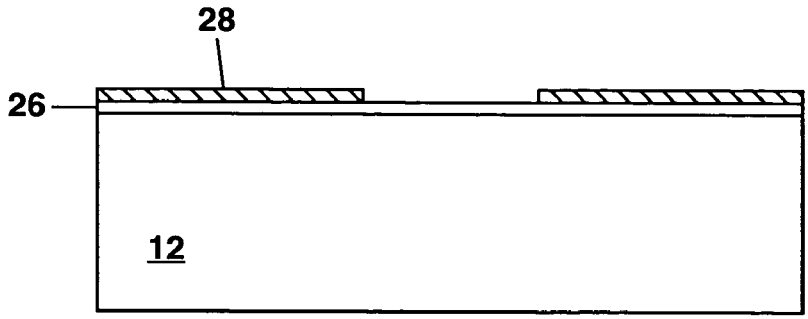
FIGS. 8A-8I show schematic cross-section views along the section line 3-3 in FIG. 7A to illustrate fabrication of the device of FIGS. 7A and 7B.

In FIG. 8A, the substrate 12 can be initially prepared as previously described with reference to FIGS. 3A and 3B. The Poly-0 layer 28 can then be blanket deposited over the substrate 12 and patterned to form the wiring 30 and the contact pads 32, while being electrically insulated from the substrate 12 by an intervening first silicon nitride layer 26. The thicknesses of the layers 26 and 28 can be as previously described.

Figure 8B:
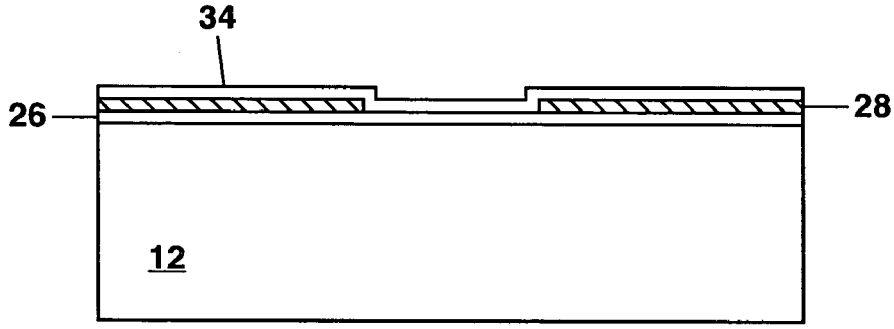

In FIG. 8B, a second silicon nitride layer 34 can be blanket deposited over the substrate 12 to encapsulate the wiring 30 and contact pads 32, and to form a bottom surface for the channel 20 which will be formed in the device 10.

Figure 8C:
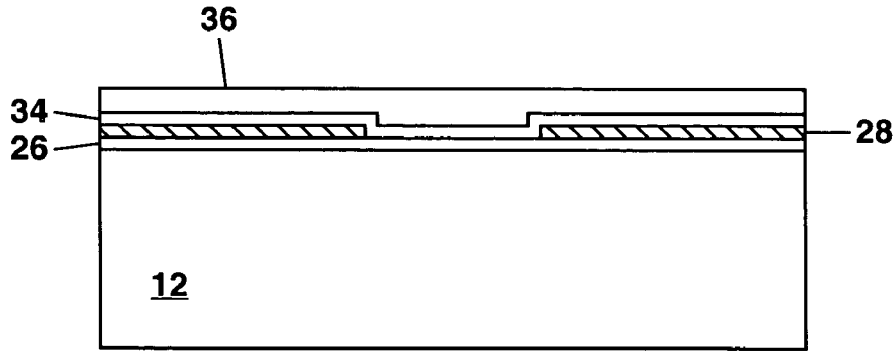
Figure 8D:
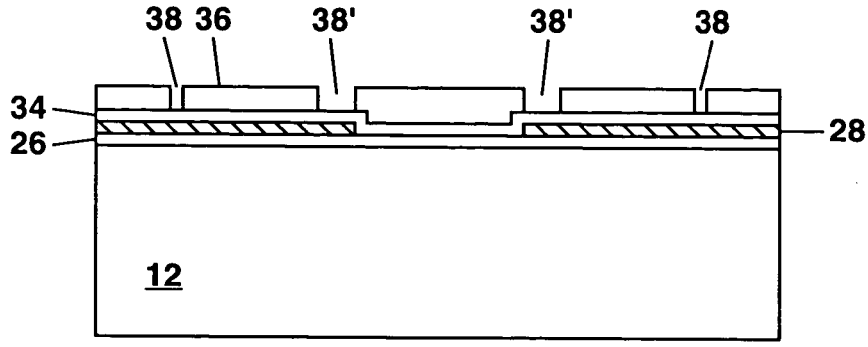

In FIG. 8C a layer of the sacrificial material 36 is blanket deposited over the substrate 12 and planarized as previously described with reference to FIG. 3E. The sacrificial material 36 can then be patterned as shown in FIG. 8D to form openings 38 that define an outline of the channel 20 to be formed, and also to form additional openings 38' at locations where the electrodes 48, which will be formed from a subsequently-deposited Poly-3 layer 42, will be electrically connected to the Poly-0 layer 28.

Figure 8E:
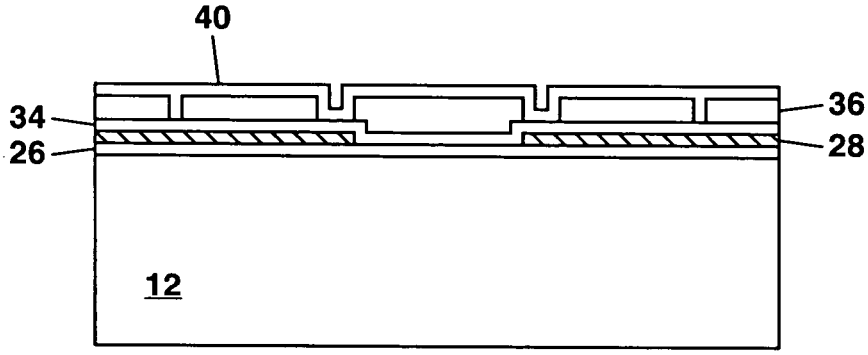
Figure 8F:
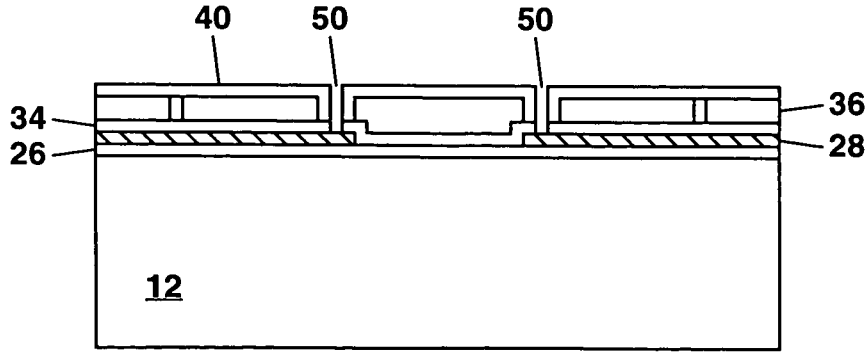

In FIG. 8E, a third silicon nitride layer 40 is blanket deposited over the substrate 12 to a thickness of 0.8 μm thereby filling in some of the openings 38, while only partially filling in other of the openings 38' which are larger than about twice the thickness of the layer 40. The third silicon nitride layer 40 can then be patterned to form openings 50 at the locations where the electrodes 48 are to be connected to the Poly-0 layer 28, with the openings 50 also extending completely through the second silicon nitride layer 34 as shown in FIG. 8F.

Figure 8G:
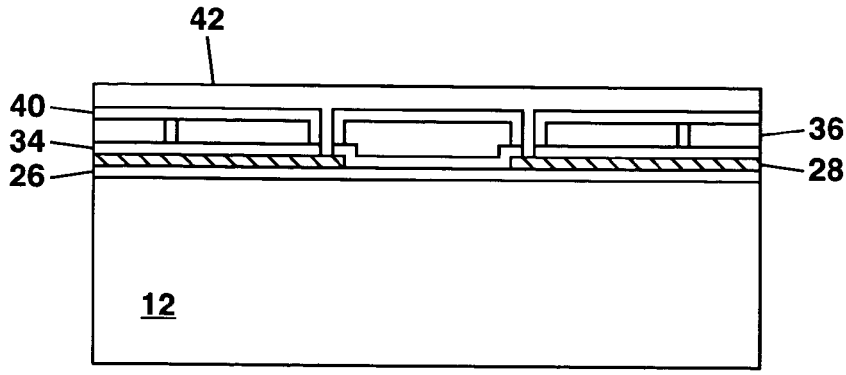

In FIG. 8G, the Poly-3 layer 42 is blanket deposited over the substrate 12 to a thickness of about 2.25 μm, with the Poly-3 layer 42 filling in the openings 50 and forming an electrical connection to the underlying Poly-0 layer 28. The Poly-3 layer 42 can be doped with phosphorous during deposition by LPCVD.

Figure 8H:
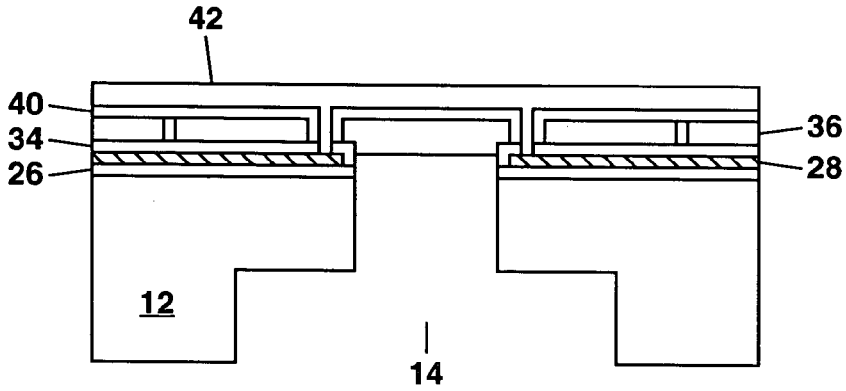

In FIG. 8H, the substrate 12 can be patterned from a bottom major surface thereof using two DRIE etch steps to form the fluid feed ports 14 and 14' as previously described with reference to FIGS. 3J and 3K. The DRIE etch steps can also etch through the first and second silicon nitride layers 26 and 34, respectively, to expose the sacrificial material 34 where the orifice 16 is to be formed.

Figure 8I:
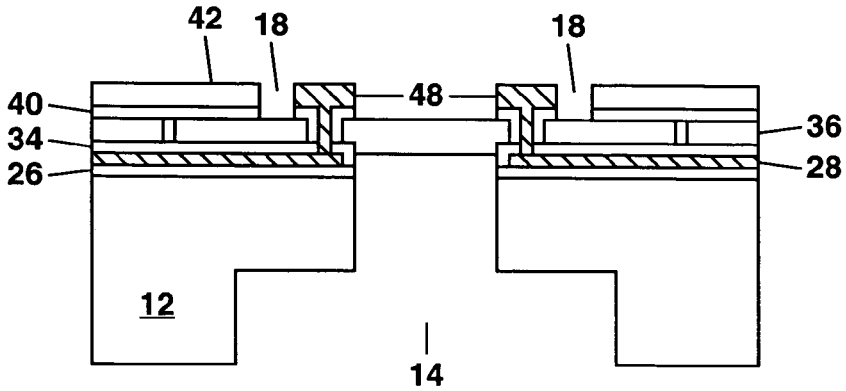

In FIG. 8I, patterning of the Poly-3 layer 42 can be performed to form the electrodes 48 and the annular orifice 18. During etching through the Poly-3 layer using reactive ion etching to form the electrodes 48 and annular orifice 18, the underlying silicon nitride layer 40 can also be etched through to expose the sacrificial material 36. The electrodes 48 formed from the patterned Poly-3 layer 42 can be semi-circular as shown in FIG. 7A with a gap 52 separating each electrode on each end thereof. The gaps 52 can be optionally filled in with a deposited electrically-insulating material such as silicon nitride or parylene which can also provide a coating over the electrodes 48, if needed. Those skilled in the art will understand that other shapes for the electrodes 48 are possible, and that a plurality of pairs of spaced apart electrodes 48 can be located about the orifice 16 in other embodiments of the present invention.

Removal of the sacrificial material 36 within the channel 20 and in the orifice 16 can then be performed using a selective wet etchant comprising HF as described previously with reference to FIG. 3L. Other portions of the sacrificial material 36 which are encased within the second and third silicon nitride layers 34 and 40 are left in place and used for structural support of the channel 20 in addition to a portion of the Poly-3 layer 42 which overlies the channel 20.

Access to the contact pads 32 can also be provided by etching through the various deposited layers overlying the Poly-0 layer 28 using reactive ion etching. The contact pads 32 can be optionally overcoated with a layer of metal (e.g. comprising gold, aluminum, tungsten, or platinum, or an alloy thereof) up to a few hundred nanometers thick.

The electrodes 48 formed from the Poly-3 layer 42 can be optionally coated with a metal layer such as platinum which can be, for example, up to a few hundred nanometers thick. This can be done, for example, by evaporation or sputtering of the metal layer using a shadow mask, or alternately by plating the metal layer over the polysilicon electrodes 48 (e.g. using electroplating). Platinum is particularly useful for providing a resistance to chemical attach for the electrodes 48, and also for its catalytic and electrochemical properties.

In other embodiments of the present invention, both electrodes 48 and heating elements 22 can be provided about each orifice 16 in the micromachined spinneret 10 to heat the fiber-forming material 100 immediately prior to extrusion and formation of the fiber 100', and to provide for molecular orientation or electrochemical reaction to condition the fiber-forming material 100 prior to or during extrusion thereof. This can be done, for example, by forming the heating elements 22 and wiring 30 thereto in the Poly-0 layer 28, and by forming the electrodes 48 and wiring 30 thereto from the Poly-3 layer 42 and a different portion of the Poly-0 layer 28, or alternately by forming the electrodes 48 and wiring thereto solely from the Poly-3 layer 42. In the latter case, the Poly-3 layer 42 can be patterned to form a bridge across the annular orifice 18 to connect each electrode 48 to the wiring 30 and contact pads 32 which can be formed from the Poly-3 layer 42. In the case of multiple concentric orifices 16 and 18 (i.e. arrays of orifices 16 and 18), the electrodes 48 can be electrically connected in parallel so that only one pair of contact pads 32 is required for all the electrodes 48.

Figure 9A:
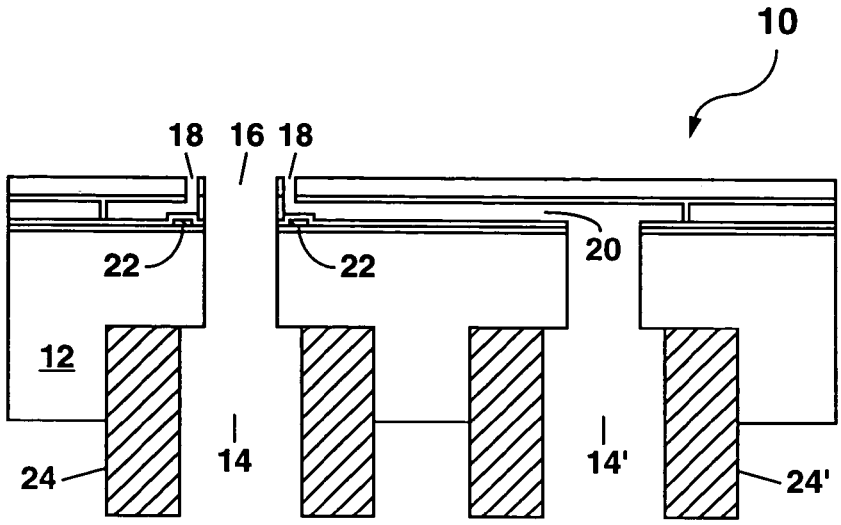
FIGS. 9A-9B show schematic cross-section views of alternative arrangements for the annular orifice in the micromachined spinneret of the present invention.
Figure 9B:
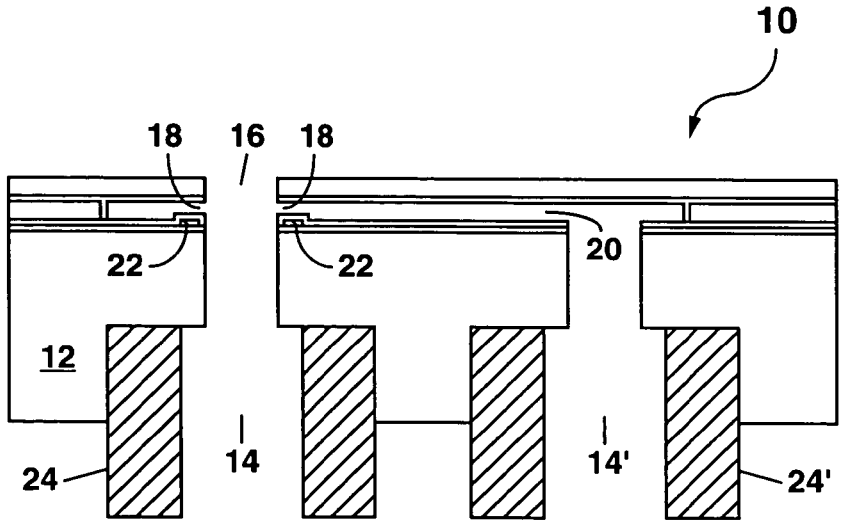

FIGS. 9A and 9B show examples of alternate arrangements for the annular orifice 18 which can be used in other embodiments of the present invention. In FIG. 9A, the annular orifice 18 is formed to closely abut the orifice 16, separated by thin layers of polysilicon (i.e. the Poly-3 layer 42) and silicon nitride (i.e. the third silicon nitride layer 40) which can be on the order of 1-2 μm thick and which are not porous or semipermeable. In FIG. 9B, the annular orifice 18 is formed concentric about the orifice 16, but empties directly into the orifice 16. This allows the co-extrudable material 110 emitted through the annular orifice 18 to be joined to the fiber-forming material 100 before the fiber-forming material 100 has exited the orifice 16. This arrangement can be advantageous, for example, when the co-extrudable material 110 is to chemically react with the fiber-forming material 100 prior to formation of the fiber 100'.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A micromachined spinneret, comprising:

(a) a substrate having a plurality of fluid feed ports formed therein extending through the substrate;

(b) at least one first orifice formed on a major surface of the substrate, with the first orifice comprising polycrystalline silicon and being connected to a first fluid feed port of the plurality of fluid feed ports; and (c) at least one second orifice formed on the major surface of the substrate as an annulus about each first orifice, with each second orifice comprising polycrystalline silicon and being connected to a second fluid feed port of the plurality of fluid feed ports.

2. The micromachined spinneret of claim 1 wherein the substrate comprises monocrystalline silicon.

3. The micromachined spinneret of claim 1 further comprising a heating element formed proximate to each first orifice.

4. The micromachined spinneret of claim 3 wherein the heating element comprises polycrystalline silicon.

5. The micromachined spinneret of claim 1 further comprising a pair of spaced-apart electrodes formed proximate to each first orifice.

6. The micromachined spinneret of claim 5 wherein each electrode comprises polycrystalline silicon or metal.

7. The micromachined spinneret of claim 1 wherein each second orifice is connected to the second fluid feed port by a fluid channel formed from a plurality of layers of silicon nitride and polycrystalline silicon.

8. The micromachined spinneret of claim 1 wherein the first fluid feed port has a width of one millimeter or less.

9. The micromachined spinneret of claim 1 wherein each first orifice has a width of 100 microns or less.

10. The micromachined spinneret of claim 9 wherein each second orifice has an annular width of 2-50 microns.

11. The micromachined spinneret of claim 1 wherein each first orifice is circular.

12. The micromachined spinneret of claim 1 wherein each first orifice is cross-shaped.

13. A micromachined spinneret, comprising:

(a) a substrate;

(b) a first array of orifices formed on one side of the substrate and connected to a first fluid feed port extending through the substrate, with the first array of orifices being formed from a plurality of deposited and patterned layers of silicon nitride and polycrystalline silicon;

(c) a second array of orifices formed on the same side of the substrate from the plurality of deposited and patterned layers of silicon nitride and polycrystalline silicon, with each orifice in the second array of orifices having an annular shape and being concentrically located about one of the orifices of the first array of orifices, and with the second array of orifices being connected to a second fluid feed port extending through the substrate.

14. The micromachined spinneret of claim 13 wherein the second array of orifices is connected to the second fluid feed port through a fluid channel formed from the plurality of deposited and patterned layers of silicon nitride and polycrystalline silicon.

15. The micromachined spinneret of claim 13 wherein the substrate comprises monocrystalline silicon.

16. The micromachined spinneret of claim 13 further comprising a heating element formed proximate to each orifice in the first array of orifices.

17. The micromachined spinneret of claim 16 wherein the heating element comprises polycrystalline silicon.

18. The micromachined spinneret of claim 13 further comprising a pair of spaced-apart electrodes formed proximate to each orifice in the first array of orifices.

19. The micromachined spinneret of claim 18 wherein each electrode comprises polycrystalline silicon or metal.

20. The micromachined spinneret of claim 13 wherein each orifice in the first array of orifices has a width of 100 microns or less.

21. The micromachined spinneret of claim 20 wherein each orifice in the second array of orifices has an annular width of 2-50 microns.

22. The micromachined spinneret of claim 13 wherein each orifice in the first array of orifices is circular.

23. The micromachined spinneret of claim 13 wherein each orifice in the first array of orifices is cross-shaped.

24. The micromachined spinneret of claim 23 wherein a portion of the cross-shaped orifices in the first array of orifices are rotated at an angle relative to the remainder of the cross-shaped orifices in the first array of orifices.

25. A micromachined spinneret, comprising:

(a) a monocrystalline silicon substrate having a plurality of fluid feed ports formed therein extending through the monocrystalline silicon substrate;

(b) a plurality of spaced-apart first orifices in fluidic communication with one of the plurality of fluid feed ports, with each first orifice being formed from a plurality of deposited and patterned layers of silicon nitride and polycrystalline silicon; and (c) a plurality of second orifices in fluidic communication with another of the plurality of fluid feed ports, with each second orifice being concentric with one of the first orifices, and being formed from the plurality of deposited and patterned layers of silicon nitride and polycrystalline silicon.

26. The micromachined spinneret of claim 25 wherein each first orifice has a circular or a cross shape, and each second orifice has an annular shape.

27. The micromachined spinneret of claim 25 further comprising a heating element located about each first orifice.

28. The micromachined spinneret of claim 25 further comprising a pair of electrodes located about each first orifice.

* * * * *